US007497708B2

(12) United States Patent
Geismayr et al.

(10) Patent No.: US 7,497,708 B2
(45) Date of Patent: Mar. 3, 2009

(54) ELECTRICAL CONNECTOR WITH SHORTING CLIP FOR VEHICULAR USE

(75) Inventors: Georg Geismayr, Weiler (AT); Thomas Bürk, Bad Liebenzell (AT)

(73) Assignee: Hirschmann Automotive GmbH, Rankweil/Brederis (AT)

( * ) Notice: Subject to any disclaimer, the term of this patent is extended or adjusted under 35 U.S.C. 154(b) by 5 days.

(21) Appl. No.: 11/514,305

(22) Filed: Aug. 30, 2006

(65) Prior Publication Data

US 2007/0049084 A1 Mar. 1, 2007

(30) Foreign Application Priority Data

Sep. 1, 2005 (DE) ..... 10 2005 041 472

(51) Int. Cl.
*H01R 29/00* (2006.01)

(52) U.S. Cl. ..... 439/188; 200/51.1

(58) Field of Classification Search ..... 439/188; 200/51.1, 51.09, 51.12
See application file for complete search history.

(56) References Cited

U.S. PATENT DOCUMENTS 4,685,887 A 8/1987 Hanning ..... 439/188
4,894,019 A * 1/1990 Howard ..... 439/188
4,906,203 A 3/1990 Margrave ..... 439/188
5,277,608 A 1/1994 Oda ..... 439/188
5,897,389 A * 4/1999 Dietz et al. ..... 439/188
2004/0229487 A1 11/2004 Lutsch ..... 439/188

FOREIGN PATENT DOCUMENTS

DE 29509313 9/1995
DE 19905043 8/2000
DE 19947042 5/2001

* cited by examiner

*Primary Examiner*—Javaid Nasri
(74) *Attorney, Agent, or Firm*—Andrew Wilford

(57) ABSTRACT

An electrical connector has a dielectric body having longitudinally opposite inner and outer faces and formed with a central cavity opening longitudinally outward at the outer face and a pair of side cavities flanking the central cavity and also opening longitudinally outward at the outer face, respective stiff contacts fixed in the side cavities and each having an outer end projecting longitudinally outward from the respective side cavity past the outer face, an elastically deformable generally U-shaped bridge clip having a bight in the central cavity and a pair of generally longitudinally extending arms each having an outer end projecting longitudinally outward from the central cavity past the outer face, each of the arm outer ends bearing transversely on a respective one of the contact outer ends in an uncoupled position of the connector. The bight is held in the cavity to retain the clip therein against longitudinal movement.

13 Claims, 3 Drawing Sheets

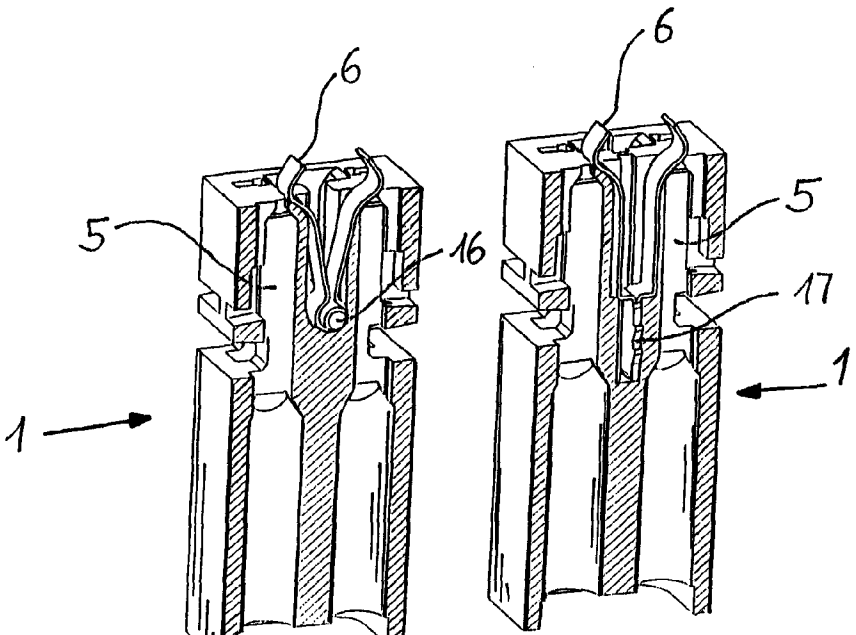
FIG. 8
FIG. 7
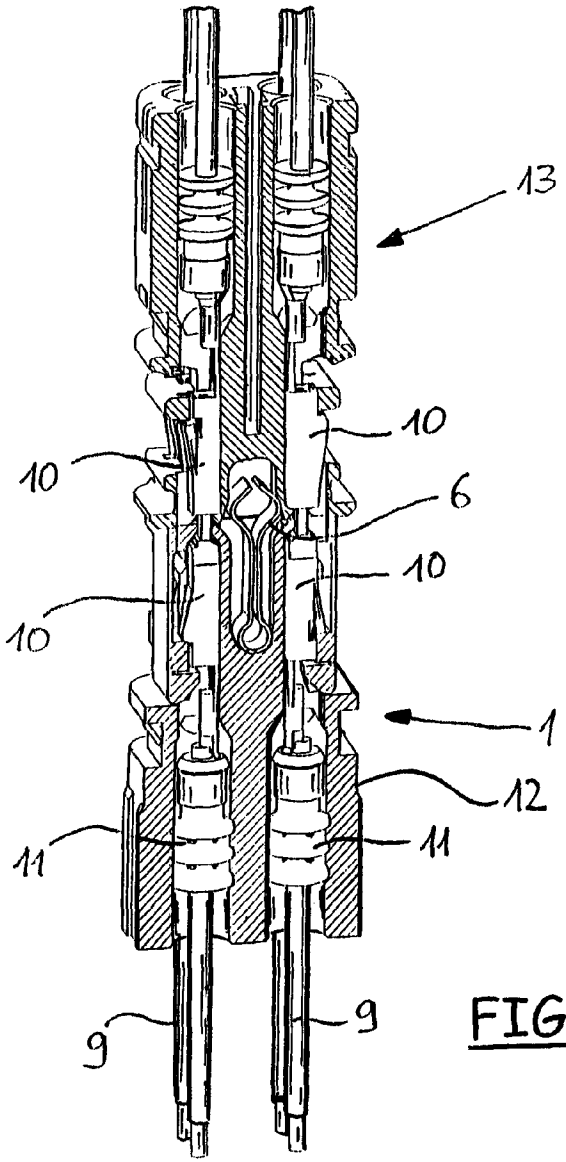
FIG. 6

ELECTRICAL CONNECTOR WITH SHORTING CLIP FOR VEHICULAR USE

FIELD OF THE INVENTION

The present invention relates to an electrical connector. More particularly this invention concerns a connector of the type used in a motor vehicle and having a shorting clip.

BACKGROUND OF THE INVENTION

Electrical connectors having short-circuit bridges are known from DE 8531 990, or DE 199 47 042. A device such as a sensor or an actuator, for example, is connected via such an connector to a unit that supplies current or signals. It is important that the contacts located on the side of the connected unit be electrically short-circuited before the connector is plugged in, to which end the known short-circuit clips or bridges are used. The short-circuit bridge thus ensures that the contacts both at the same potential, and interference or noise voltages do not result in an unintended function, in particular a safety-critical function of the connected unit. Such a safety-critical situation occurs, for example, when an ignition unit (pyrotechnic generator) is connected to the electrical connector via a cable before the electrical connector is connected via a second connector to the deployment unit (control unit). This frequently happens when, for example, the pyrotechnic unit is prefabricated by a supplier for the vehicle manufacturer, and the pyrotechnic unit is not installed and electrically contacted until the vehicle is assembled. Up until that time it must be ensured that interference or noise voltages, which are somehow applied to the contacts for the electrical connector for the pyrotechnic unit or else act on the pyrotechnic unit as a whole, do not result in malfunction (in particular ignition of the gas generator), since this is a safety-critical situation.

From this standpoint the short-circuit bridge known from the prior art fulfills its principal function, but has disadvantages in its design that result in adverse electrical effects. Thus, the short-circuit bridge from DE 8531 990, may be fixed in the plug part using a very complicated procedure that results in increased assembly costs. The contact surfaces of the short-circuit bridge, which in this embodiment rest against the contacts, are the punched edge, resulting in non-uniform line contact that lacks satisfactory electrical properties. In addition, the actuating ends of the short-circuit bridge that are decoupled from the contact surface shorten the contact overlap between the contact (contact pin) for the plug and the contact (contact socket) for the second connector during the plug-in process, and therefore require, for example, longer contact pins on the plug side. To enable the regions of the short-circuit bridge resting against the contacts for the plug part to be raised when the plug and second connector are connected, abutments that project in the region of the second connector are necessary, which entail the risk of breaking off. Since the abutments are broken off specifically on the end face of the second connector, which can easily happen when the plug and second connector are connected together, the contact surfaces of the short-circuit bridge do not lift off the contact pins, resulting in constant short-circuiting of the entire electrical connection and impairment or even failure of the functioning of the overall system. In particular for safety-critical systems this has serious disadvantages for use in vehicles when, for example, the function of an air bag or a seat belt tensioner fails if the vehicle is involved in an accident.

Further connectors of this type are described in U.S. Pat. Nos. 4,906,203, and 5,277,608,, US patent publication 2004/0229487,, German utility model 295 09 313, and German published application 199 05 043. These systems are all relatively complex and are prone to damage in the uncoupled condition. A further disadvantage of these systems is that the shorting clip is frequently disconnected as the connector is being coupled up, before a good connection is formed so that for a brief instant there is a distinct possibility of an electrostatic charge or spurious current getting through the connector.

OBJECTS OF THE INVENTION

It is therefore an object of the present invention to provide an improved electrical connector with shorting clip for vehicular use.

Another object is the provision of such an improved electrical connector with shorting clip for vehicular use that overcomes the above-given disadvantages, in particular that is of very simple construction but still quite robust.

A yet further object is to provide such an improved connector that maintains a short across its contacts until the contacts are in good electrical connection with the mating contacts of the other plug or socket element the connector is being coupled to.

SUMMARY OF THE INVENTION

An electrical connector has according to the invention a dielectric body having longitudinally opposite inner and outer faces and formed with a central cavity opening longitudinally outward at the outer face and a pair of side cavities flanking the central cavity and also opening longitudinally outward at the outer face, respective stiff contacts fixed in the side cavities and each having an outer end projecting longitudinally outward from the respective side cavity past the outer face, an elastically deformable generally U-shaped bridge clip having a bight in the central cavity and a pair of generally longitudinally extending arms each having an outer end projecting longitudinally outward from the central cavity past the outer face, each of the arm outer ends bearing transversely on a respective one of the contact outer ends in an uncoupled position of the connector, and means in the cavity engaging the bight for retaining the clip therein against longitudinal movement.

Thus according to the invention the short-circuit bridge or clip is fixed in the body by means of a lock-fit connection, and the ends of the short-circuit bridge project slightly beyond the end face of the body, on the contacting side of the first connector or the second connector. In this manner the short-circuit bridge, which can be made a simple stamping and bending process, for example, may be quickly and easily fixed in the body for the connector simply by inserting it and then automatically locking it in place. In addition, in this structural design the adjacent short-circuit clip imposes much less stress on the contact parts. The axial position of the contact surface of the short-circuit bridge is just past the contact pin outlet opening.

A further advantage of the short-circuit bridge according to the invention is that it is inserted in the body and shaped in such a way that the contacts lie flat against the short-circuit bridge, specifically, not at the edges of the short-circuit bridge but on support surfaces thereof that extend at right angles to the edges. To this end, the contact surface of the short-circuit bridge has a curved or rounded shape, in particular a semicircular shape, which results in a secure line contact between contact surfaces of the short-circuit clip and the contacts. This contact surface or also the entire short-circuit clip may be precoated, e.g. with gold or copper, to impart improved electrical properties. Because the short-circuit clip, i.e. the contact surfaces thereof, projects slightly beyond the end face of the body, it may have a very simple shape due to the fact that its actuating ends are situated directly over the end face (contact surface) of the first connector or the second connector. This also results in an optimum contact overlap in the decoupled position, that is until decoupling of the short-circuit clip (connection of the first connector and second connector), since according to the invention the actuating end of the short-circuit clip is situated directly over the end face of the first connector. In contrast, the second connector has no projecting actuating ends that result in lifting of the contact surfaces of the short-circuit clip, but instead has bevels inside the second connector body that cause the contact surfaces of the short-circuit clip to lift up against the contacts of the first connector when the first connector and second connector are connected. In general, this means that the second connector does not require projections, only a free space, optionally with or without bevels, for accommodating the short-circuit clip that is present on the plug side.

A further advantage of the short-circuit clip according to the invention located in a cavity of the body for the first connector (or the second connector), in addition to the simple and quick assembly, is the resulting compactness of the first connector, since the cavity may be provided next to the cavities for the contacts without increasing the outer geometric dimensions of the body. Thus, the invention results not only in a simple and economical design of the short-circuit clip, but also a compact structure for the entire plug-in connector due to the fact that only a small additional installation space is required for the short-circuit clip, which is more or less present anyway inside the body for the first connector or for the second connector. A simple and economical design of the short-circuit clip is achieved by manufacturing same as a part separate from the first connector or the second connector, specifically, in a stamping and bending process. The short-circuit clip after manufacture may be used to improve the electrical properties, in particular to avoid corrosion, or may be electroplated, and both the manufacture and assembly of the short-circuit clip may be carried out manually, or preferably in an automated manner. This is particularly important for the mass production of first connectors and second connectors of plug-in connectors for automotive use.

In summary, it is important and advantageous to design the axial position of the contact surface of the short-circuit clip in such a way that the short-circuit clip is positioned very close to the contact pin outlet opening in the first connector or second connector. The fact that the contact pin is guided in the cavity up to and including the outlet opening of the first connector, being thereby supported, prevents the contact pin from being bent by the short-circuit clip contacting force.

BRIEF DESCRIPTION OF THE DRAWING

The above and other objects, features, and advantages will become more readily apparent from the following description, reference being made to the accompanying drawing in which:

FIG. 6 is an axial section through a pair of coupled-together connectors; and FIGS. 7 and 8 are axial sections through variants on the system of this invention.

SPECIFIC DESCRIPTION

Figure 1:
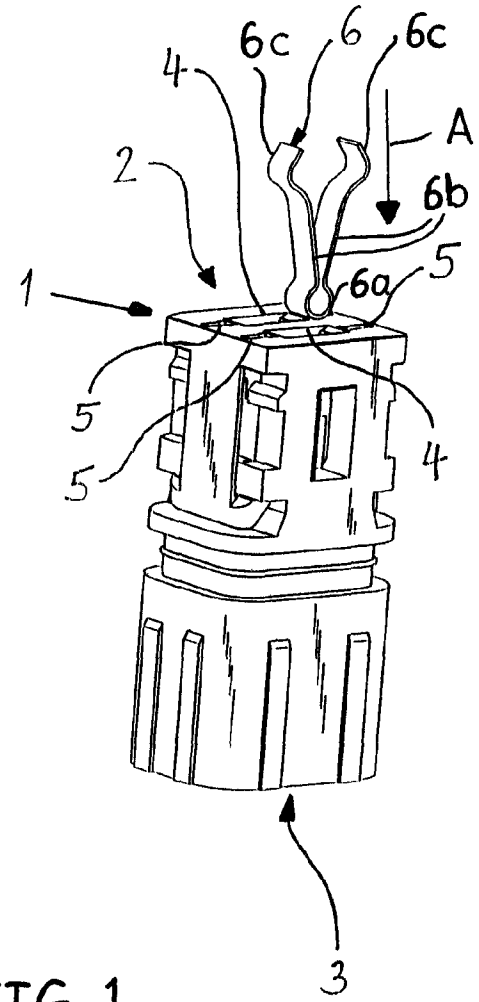
FIG. 1 is a perspective exploded view of a connector according to the invention before assembly.

As seen in FIG. 1 a plug or first connector 1 has a dielectric molded-plastic body 12 with an outer end face 2 and an inner end face 3. The body 12 is formed with at least one (here two) central cavity 4 opening at the outer end face 2 and with a pair of smaller side cavities 5 flanking the cavity 4 and also open at the outer end face 2.

The cavity 4 is designed to accommodate a short-circuit clip 6, the position of the cavity 4 (or multiple cavities 4) with respect to the adjoining cavities 5 being selected so that at least one short-circuit clip 6 always electrically contacts one respective contact situated in two cavities 5. This means, for example, that for multi-row designs of the plug 1 the cavity 4 is situated in the center, and externally adjacent thereto one cavity 5 is provided for each contact. In addition to the cavity 4 for the short-circuit clip 6, as well as the cavities 5 for the contacts, however, it is possible but not necessary for the plug 1 to have a type of shape adapted to secure contacts inside the plug 1 (such as in primary locks and possibly secondary locks, for example).

As seen in FIG. 1, the short-circuit clip 6 is fitted into the plug 1 by inserting it into the cavity 4 from the contacting side 2, in the direction of the arrow A of FIG. 1. After this is performed, the short-circuit clip 6 assumes the position inside the cavity 4 illustrated in section in FIG. 2. It can be seen that the plug 1, as a locking means for fixing the short-circuit clip 6 in the cavity 4, has at least one catch hook 7 for each short-circuit clip 6, the catch hook 7 in this case having an oblong design and having a projection on its end. This projection secures an essentially circular end region 6*a*, of the short-circuit clip 6 to be fixed in the cavity 4, thereby preventing the short-circuit clip 6 from leaving this cavity 4. For easier assembly of the short-circuit clip 6 the end region of the catch hook 7 is slightly beveled, which allows the short-circuit clip 6 to be pushed into the cavity 4 and fixed there in a very simple manner. The cross section of the projection of the catch hook 7 conforms to the greatest extent possible to the cross section of the essentially circular end 6*a*, of the short-circuit clip 6. The catch hook 7 is designed to be movable, in particular elastically, to allow the end of the catch hook 7 to engage with the circular end region 6*a*, of the short-circuit clip 6 around t. The plug 1 has a window 8, illustrated in FIG. 3, so that the catch hook 7 can spring back when the short-circuit clip 6 is inserted into the cavity 4. This window 8 not only allows the catch hook 7 to be deflected when the short-circuit clip 6 is inserted into the cavity 4, but it is also used for manufacturing the catch hook 7 during the injection molding process for the plug 1, since the appropriate slide for manufacturing the catch hook 7 may be introduced through the window 8.

Figure 3:
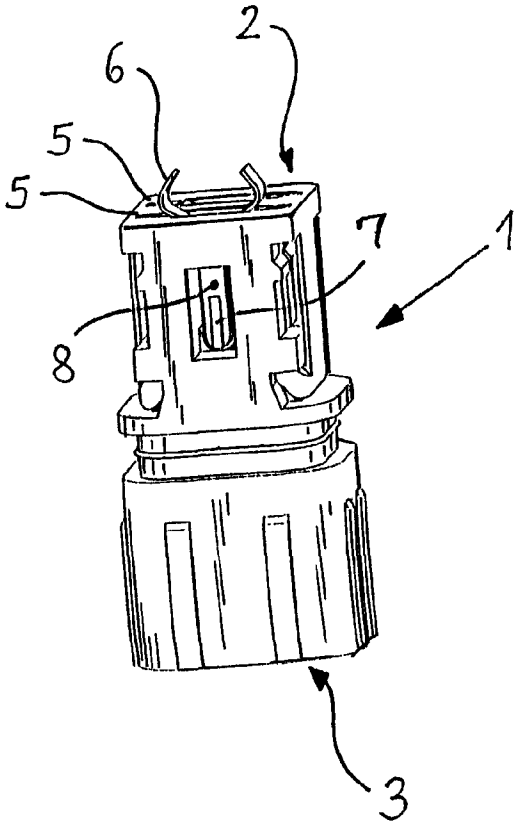
FIG. 3 is a perspective view of the structure as shown in FIG. 2.
Figure 2:
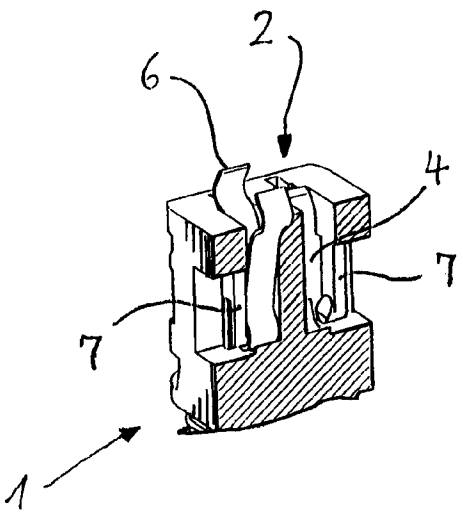
FIG. 2 is an axial section through the connector when partially assembled.
Figure 4:
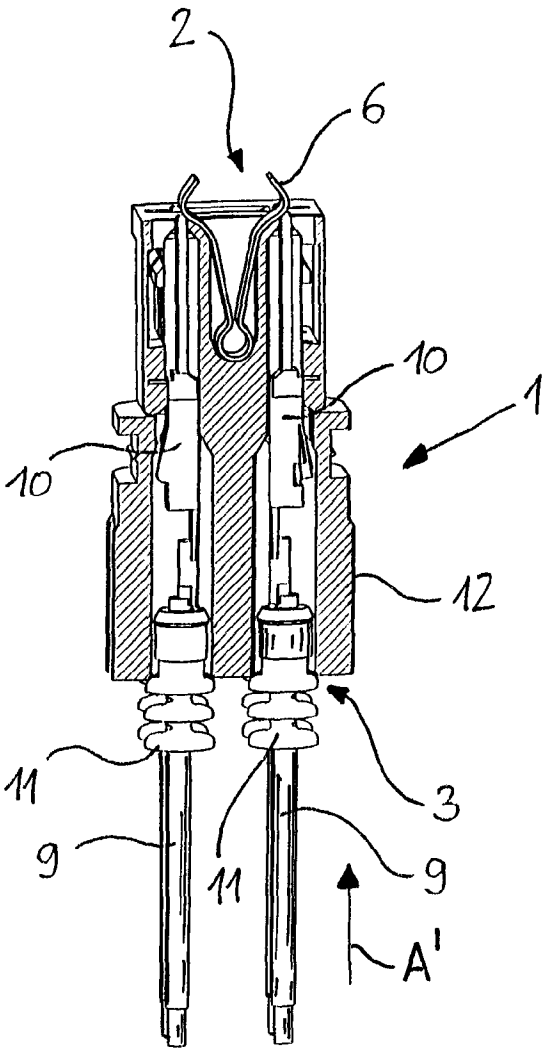
FIG. 4 is an axial section through the connector at a later stage of assembly.

Lastly, FIG. 4 shows a plug 1 that is practically completely assembled, with cable 9 extending from the cable outlet face 3. Rigid metal contact blades 10 are attached to the ends of the cable 9 (stranded cable, for example, but other types of cable such as ribbon cable also being possible), and in this case are designed as contact pins for the plug 1. The cable ends, prepared in this manner and shown in FIG. 4, together with their contacts 10 are each inserted into the cavities 5 in the plug 1 provided for this purpose and fixed there (in a manner known as such, using locking means for primary locks and possibly secondary locks). It is also possible, but not necessary, for seals 11 to be present that seal off the respective cable 9 from the body 12 of the plug 1. If such seals 11 are present, this has the advantageous effect of longitudinal water tightness for the plug 1. FIG. 4 shows that to obtain a completely assembled plug 1 it is still necessary to push the contacts 10 together with the cable 9 and the seals 11 further into the body 12 for the plug 1, in the direction of the arrow A1 in FIG. 4. When this is performed, as shown in FIGS. 2 and 3, outer ends 6*c*, of legs 6*b*, of the short-circuit clip 6, i.e., the contact surfaces thereof, project slightly beyond the end face 2 of the body 12, while at the same time outer ends the contact pins 10 also project past the face 2 and bear on the curved end side of the outer ends 6*c*, of the short-circuit clip 6.

Figure 5:
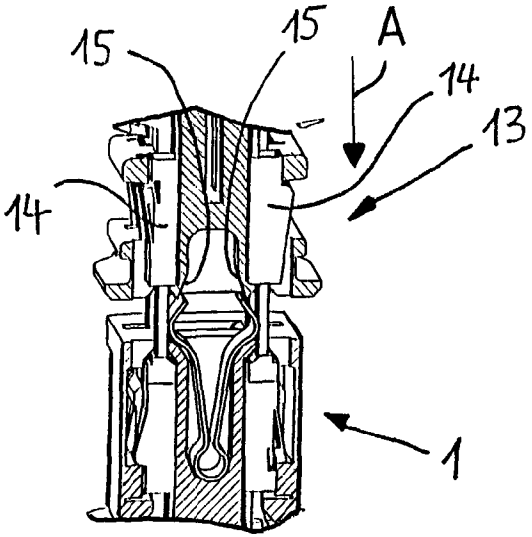
FIG. 5 is an axial section showing the connector according to the invention at the starting phase of coupling to another connector.

FIG. 5 shows the completed plug 1. The pin-shaped ends of the contacts 10 have come to rest against the curved end region 6*a*, in line contact. FIG. 5 also shows a second connector 13 having a geometric shape that allows it to be connected to the plug 1 to produce a plug-in connector assembly for automotive use. The second connector 13 has contacts 14 that are designed as sockets. On its outer end face the body for the second connector 13 has beveled formations 15 that are designed to actuate the short-circuit clip 6 on the side of the plug 1. A second connector 13 with such a design has the advantage that for actuating the short-circuit clip 6 on the side of the plug 1 no projections are present that could break off and possibly lead to malfunction.

The mode of operation of the bevels 15 on the side of the second connector 13 is such that the bevels are shaped so that when the plug 1 and second connector 13 are connected the bevels cooperate with the end region of the short-circuit clip 6 that projects beyond the contacting side 2 of the plug.

Operation is as follows:

As long as the second connector 13 is not placed on the plug 1, the ends 6*a*, of the short-circuit clip 6 rest against the ends of the contacts 10 for the plug 1. If the second connector 13 is then placed on the plug 1 in the direction of the arrow A in FIG. 5, the length of the contacts 10 causes them to come into contact with the contacts 14 for the second connector 13, while the short-circuit clip 6 is still bearing on the contacts 10 for the plug 1. This ensures that all contacts 10 and 14 are at a defined electrical voltage, normally grounded via the short circuit clip 6, before initial operation and during the plug-in process. Only after the contacts 10 for the plug 1 are pressed past a certain length into the contacts 14 for the second connector 13 do the beveled tongue formations 15 of the second connector 13 act on the curved ends 6*a*, of the short-circuit clip 6 and press them inward as the plug 1 and second connector 13 are brought closer together, so that in the connected state of the plug 1 and second connector 13 the contact ends 6*a*, of the short-circuit clip 6 are off the contacts 10 and the short circuit is eliminated. This situation is illustrated in FIG. 6, which shows a sectional view of the completed structure of the plug 1 and second connector 13 in the coupled state. It is also seen that the connector 13 has a recess on the end face in the region of the bevels 15, so that in the connected state of the plug 1 and second connector 13 the short-circuit clip 6 is located in this recess.

FIG. 7 shows that the short-circuit clip 6 is alternatively fixed by means of a pin 16 that locks into the body 12.

FIG. 8 shows that the short-circuit clip 6 has a serrated end 17 that locks into a corresponding recess in the body 12 or that may be pressed therein, for which purpose the serrated end 17 has an approximately barb-like shape. A weld or glue joint is also provided at the end 17.

We claim:

1. An electrical connector comprising:

a dielectric body having longitudinally opposite inner and outer end faces and formed with a central cavity opening longitudinally outward at the outer end face and a pair of side cavities flanking the central cavity and also opening longitudinally outward at the outer end face;

respective stiff contacts fixed in the side cavities and each having an outer end projecting longitudinally outward from the respective side cavity past the outer end face;

an elastically deformable generally U-shaped clip having a bight in the central cavity and a pair of generally longitudinally extending arms each having an outer end projecting longitudinally outward from the central cavity past the outer end face, each of the arm outer ends bearing transversely on a respective one of the contact outer ends in an uncoupled position of the connector; and means in the cavity engaging the bight for retaining the clip therein against longitudinal movement.

2. The electrical connector defined in claim 1 wherein the means is a hook formation molded with the body and engaging the bight between the arms.

3. The electrical connector defined in claim 2 wherein the body is formed with a transversely open aperture aligned with the hook formation.

4. The electrical connector defined in claim 2 wherein the hook formation is elastically deformable.

5. The electrical connector defined in claim 1 wherein the arms diverge away from the bight and the arm outer ends are outwardly convexly rounded.

6. The electrical connector defined in claim 1 wherein the bight is formed with a toothed extension seated in the body.

7. The electrical connector defined in claim 1 wherein the bight is part cylindrical.

8. The electrical connector defined in claim 7 wherein the means is a pin set in the body and projecting transversely through the bight.

9. The electrical connector defined in claim 1 wherein the means is a glue or weld joint securing the bight in the body.

10. The electrical connector defined in claim 1 wherein the rigid contacts are substantially stronger than the clip arms so that the clip arms do not deform the contacts when bearing elastically transversely on them.

11. The electrical connector defined in claim 1, further comprising a second connector body separate from the first-mentioned body and having an outer end face;

respective contacts exposed at the second-body outer end face and matable with the contacts of the first body when the outer end faces are closely juxtaposed; and respective formations on the second body engageable between the arm outer ends and the respective contacts of the first body when the outer faxes are closely juxtaposed and the contacts of the second body are mated with the contacts of the first body.

12. The electrical connector defined in claim 11 wherein the formations are recessed in the second body behind the outer end face thereof.

13. The electrical connector defined in claim 11 wherein the formation are dielectric tongues extending along side faces of the contacts of the second body.

* * * * *